US006416028B1

(12) United States Patent
Miller et al.

(10) Patent No.: US 6,416,028 B1
(45) Date of Patent: Jul. 9, 2002

(54) DEVICE AND METHOD OF HANGING ELEVATOR PADS

(75) Inventors: Harry Miller, Weston; Brett Peter Masters, Belmont; Marco Serra, Arlington, all of MA (US)

(73) Assignee: Harry Miller Co., Inc., Boston, MA (US)

( * ) Notice: Subject to any disclaimer, the term of this patent is extended or adjusted under 35 U.S.C. 154(b) by 0 days.

(21) Appl. No.: 09/794,640

(22) Filed: Feb. 27, 2001

(51) Int. Cl.[7] ..... A47G 1/10; B66B 7/00

(52) U.S. Cl. ..... 248/339; 248/316.5; 187/414; 223/96

(58) Field of Search ..... 248/339, 684, 248/689, 301, 305, 306, 316.1, 316.5; 223/96; 187/414

(56) References Cited

U.S. PATENT DOCUMENTS 541,384 A * 6/1895 Pascoe ..... 24/8
925,828 A * 6/1909 Newton et al. ..... 24/51
2,038,043 A * 4/1936 Hasselblad ..... 248/316.5
3,914,828 A * 10/1975 Noda ..... 24/504
4,112,951 A * 9/1978 Hulka et al. ..... 128/831
4,169,549 A * 10/1979 Takagi ..... 223/96
4,308,981 A * 1/1982 Miura ..... 223/96
4,924,973 A * 5/1990 Miller ..... 187/414
5,165,147 A * 11/1992 Kuo ..... 24/346
5,236,760 A * 8/1993 Jinn ..... 428/100
5,640,742 A * 6/1997 White et al. ..... 24/3.12
5,732,921 A * 3/1998 Lemire ..... 248/317

* cited by examiner

*Primary Examiner*—Anita King
(74) *Attorney, Agent, or Firm*—Hale and Dorr LLP

(57) ABSTRACT

A method and device for hanging elevator pads. An elevator pad clamp is disclosed that includes a back plate having an attachment end for holding the back plate in relation to an elevator wall and having two wing segments extending away from a surface of the back plate. A clamp plate is hinged to the wing segments at a clamp axis, and a spring is hinged to the wing segments and positioned to bias the clamp plate in a first state. A lever portion is hinged to the wing segments at a lever axis. The lever portion has an urging member shaped to urge against a first surface of the clamp plate as the lever portion is rotated about the lever axis to cause the clamp plate to rotate about the clamp axis. The clamping device has two states. In an open state the clamp plate and the back plate define an open set of elevator-pad receiving jaws. The device may remain in the open state without depressing the lever. In a closed state, the jaws are closed and locked. The device may remain in the closed state without depressing the lever.

5 Claims, 8 Drawing Sheets

DEVICE AND METHOD OF HANGING ELEVATOR PADS

BACKGROUND

1. Field of the Invention

This invention relates generally to a spring-loaded clamp for, and method of, hanging an elevator pad.

2. Description of the Related Art

Elevator pads are used to protect elevator walls from being scratched or damaged when the elevator is being used to carry large or bulky objects such as furniture. One common approach is to use custom tailored elevator pads in which grommets are formed into the pad at positions corresponding to hooks or plugs protruding from the elevator walls. This method is costly as each pad must have custom made and positioned grommets. Another method forms straps on one side of the pad so that the pad's straps may be placed over protruding hooks. This approach also suffers from the cost of creating and forming the strap and at times is inconvenient to use. Another method uses a clothespin-like clamp to hold the pad, in which the clamp must be pressed to open the jaws in scissors-like fashion. See (http://www.westcoastpads.com/hooks).

SUMMARY

The invention provides an improved method and device for hanging elevator pads. According to one aspect of the invention, an elevator pad clamp is provided that includes a back plate having an attachment end for holding the back plate in relation to an elevator wall and having two wing segments extending away from a surface of the back plate. A clamp plate is hinged to the wing segments at a clamp axis, and a spring is hinged to the wing segments and positioned to bias the clamp plate in a first state. A lever portion is hinged to the wing segments at a lever axis. The lever portion has an urging member shaped to urge against a first surface of the clamp plate as the lever portion is rotated about the lever axis to cause the clamp plate to rotate about the clamp axis.

According to another aspect of the invention, the clamping device has two states. In an open state the clamp plate and the back plate define an open set of elevator-pad receiving jaws. The device may remain in the open state without depressing the lever. In a closed state, the jaws are closed and locked. The device may remain in the closed state without depressing the lever.

DETAILED DESCRIPTION

Figure 1:
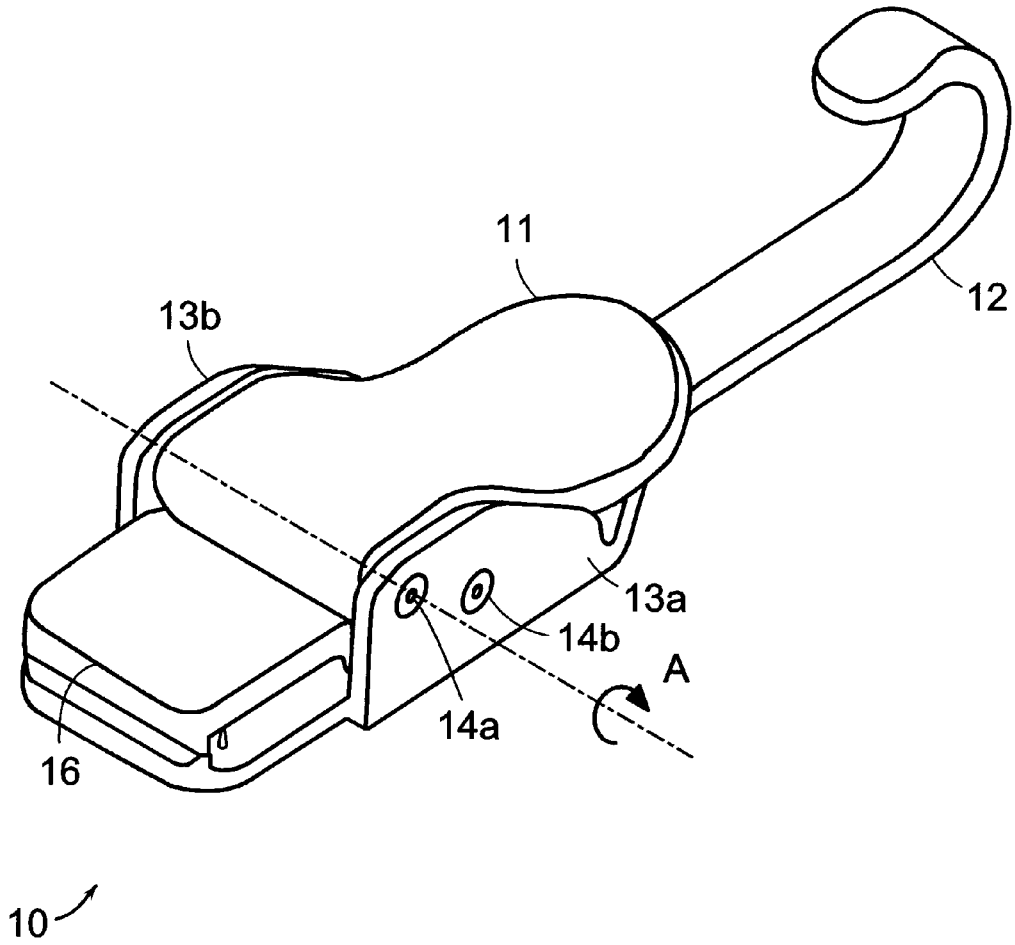
FIG. 1 is a perspective view of an elevator pad clamping device of a preferred embodiment of the invention.

FIG. 1 is a perspective view of a preferred embodiment of an elevator pad clamping device 10 shown in a closed, or clamping, state. Clamp 10 includes a back plate 12 having two side wings 13*a* and 13*b*, a thumb depressible lever 11 is hinged to the wings 13*a,b* of the back plate 12 with pin 14*a*, and clamp plate 16 is hinged to the wings 13*a,b* of the back plate with pin 14*b*. A spring 15 (not shown in this figure) is positioned between the clamp plate 16 and the back plate 12.

Figure 2:
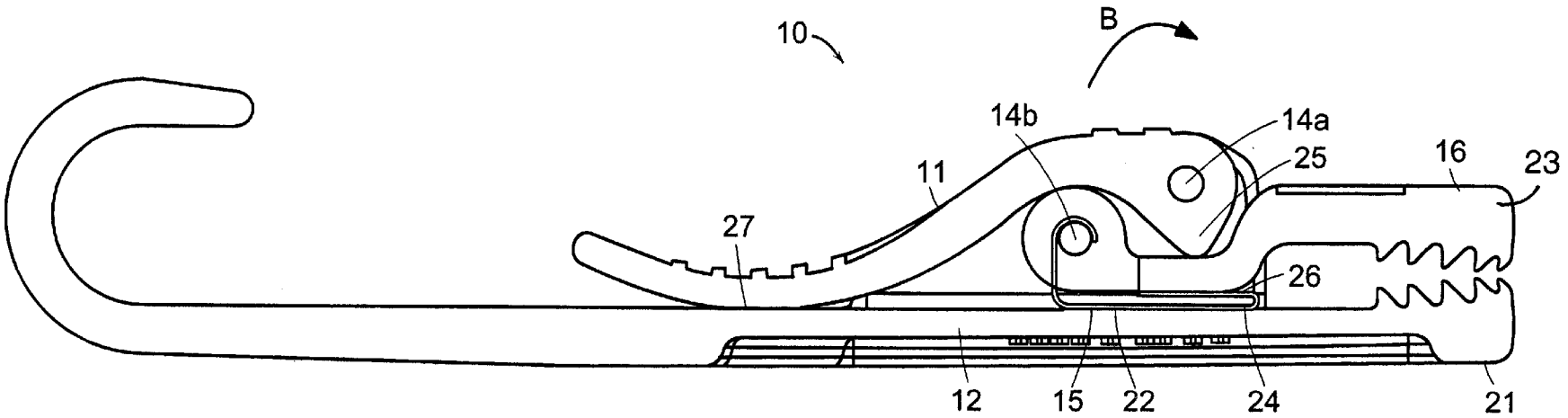
FIG. 2 is a longitudinal cross-section of a preferred embodiment.
Figure 5:
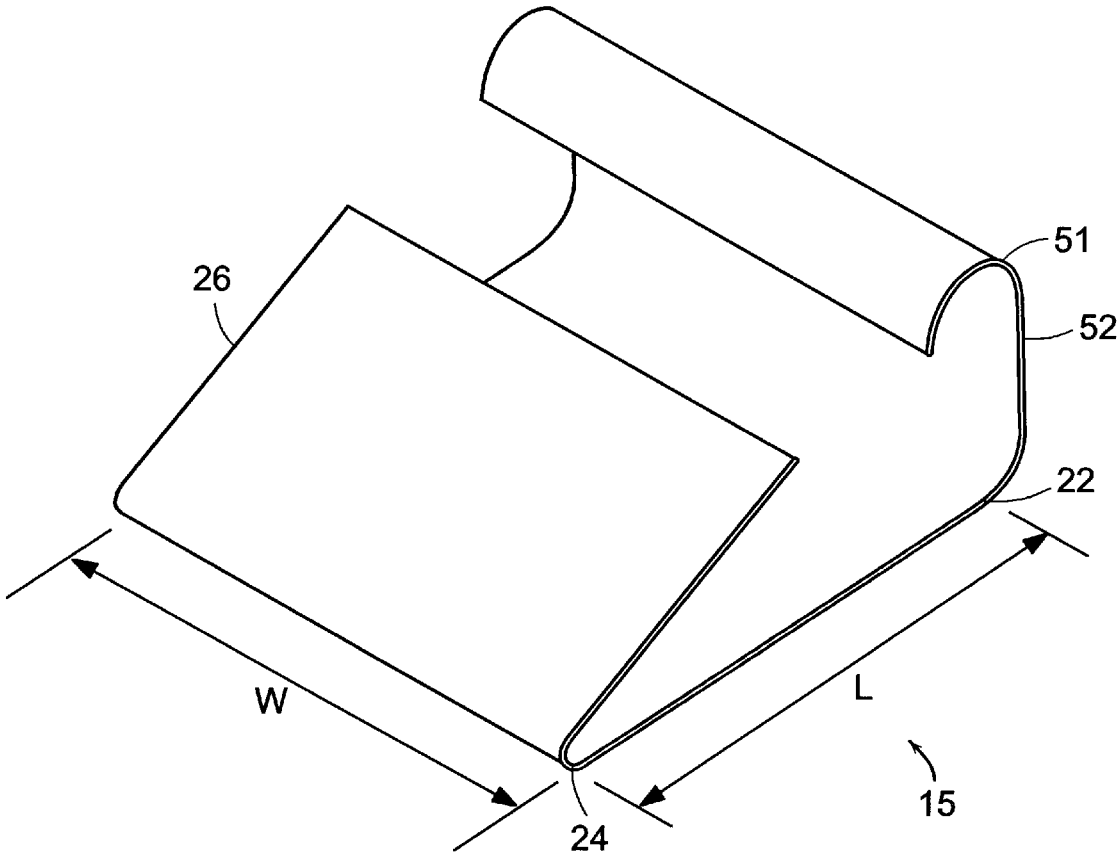
FIG. 5 is a perspective view of a preferred spring.

FIG. 2 shows a longitudinal cross section of an exemplary embodiment of a clamp 10. Clamp plate 16 pivots around pin 14*b*, and thumb depressible lever 11 pivots around pin 14*a*. Spring 15 has a first portion 22, second portion 26, and a vertex 24, and it is positioned around pin 14*b* and between the clamp plate 16 and back plate 12. In its natural state, the first and second spring portions 22, 26 are spaced apart by an angle between 30 and 45 degrees. As shown in FIG. 5, the spring is in a compressed state in which the second portion 26 is urged toward the first 22.

As shown in this figure, the device 10 is in a closed, locked state. Urging portion 25 is roughly perpendicular to a portion of clamp plate 16 and thus holds the clamp plate down toward the back plate 12. The lever 11 is shaped so that a roughly perpendicular position of urging member 25 corresponds with the a portion 27 of the lever contacting the back plate 12. In this state, the lever 11 may be released, but the device will remain closed. In the closed state, distal portion 23 of clamp plate 16 and distal portion 21 of back plate 12 define closed jaws which can hold an elevator pad firmly.

If the lever 11 is lifted to rotate about pin 14*a* as shown by arrow B, urging member 25 slides along the clockwise direction shown along the top surface of the clamp plate 16. This allows the spring to gradually release from the compressed state and to force the clamp plate away from the back plate 12. The lever 11 may be lifted to a point at which the spring 15 will urge the clamping plate 16 into a fully open state. At this point, the device 10 stays in the open state naturally and the lever 11 may be released by the user until the user desires the clamp to close. In the open state, distal portion 23 of clamp plate 16 and distal portion 21 of back plate 11 define open jaws into which an elevator pad may be received or released.

Figure 3A:
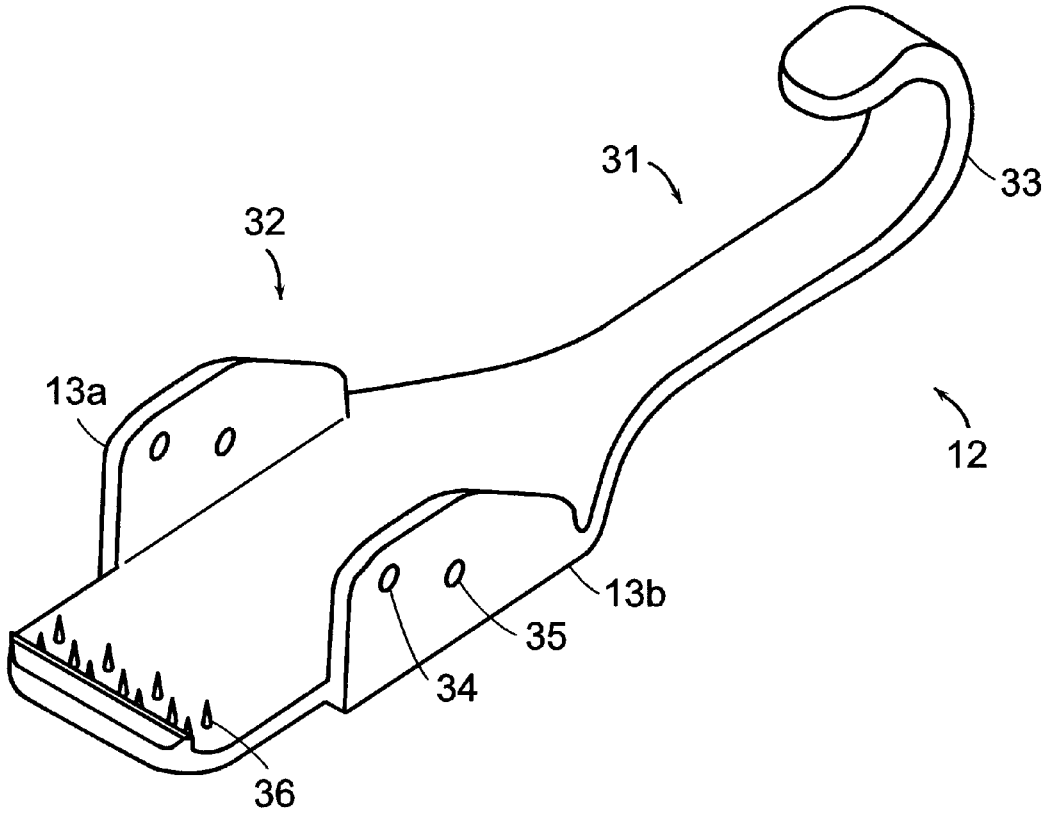
FIGS. 3A–C is a perspective view of preferred back plates.
Figure 3B:
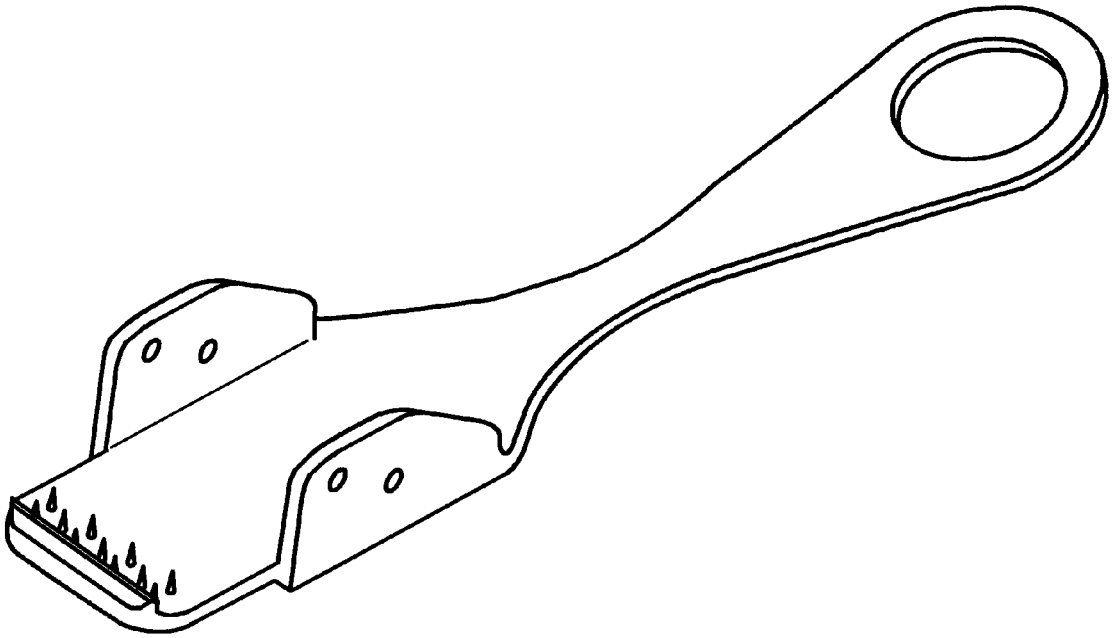
Figure 3C:
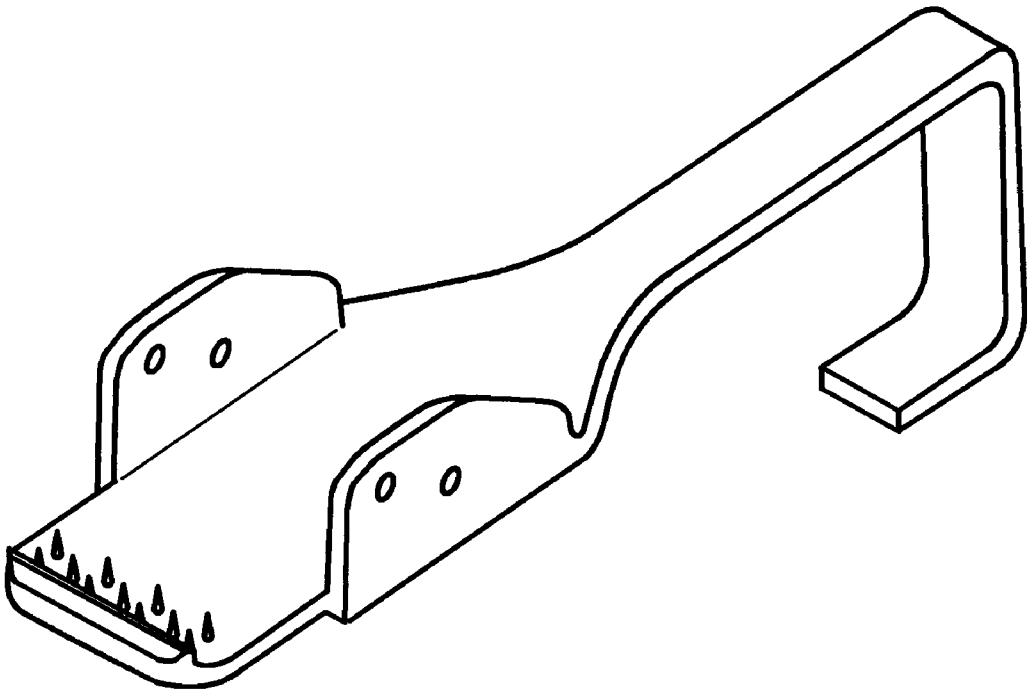

FIG. 3A shows a preferred back plate 12 in more detail. As shown, exemplary embodiments have a tapered design in which there's a thinner extension portion 31 having a hooked end 33 and a wider portion 32 toward the device's distal end. Wings 13*a,b* protrude from the wider portion and define through holes 34, 35 for receiving the pins 14*a,b* mentioned above. The holes 34 and 35 are offset relative to one another to define the pivots described above. In this embodiment, pivot hole 35 is about 0.25 inches, radially away from pivot hole 34 and about 0.15 inches farther away from the back plate surface. In addition, in this embodiment the hooked end 33 has a radius of about 0.3 inches; the length of the back plate is about 4.3 inches; the wider portion is about 1.2 inches wide; and the wings protrude about 0.5 inches. The distal end is slightly curved, as described above to define a portion of the jaws of the device 10, and includes upwardly protruding teeth 36. The hooked end 33 of this embodiment is suitable for some elevators, but other embodiments will have other configurations to hook over paneling or other fixtures. See FIGS. 3B–C for other embodiments of back plates, suitable for other elevator arrangements.

Figure 4:
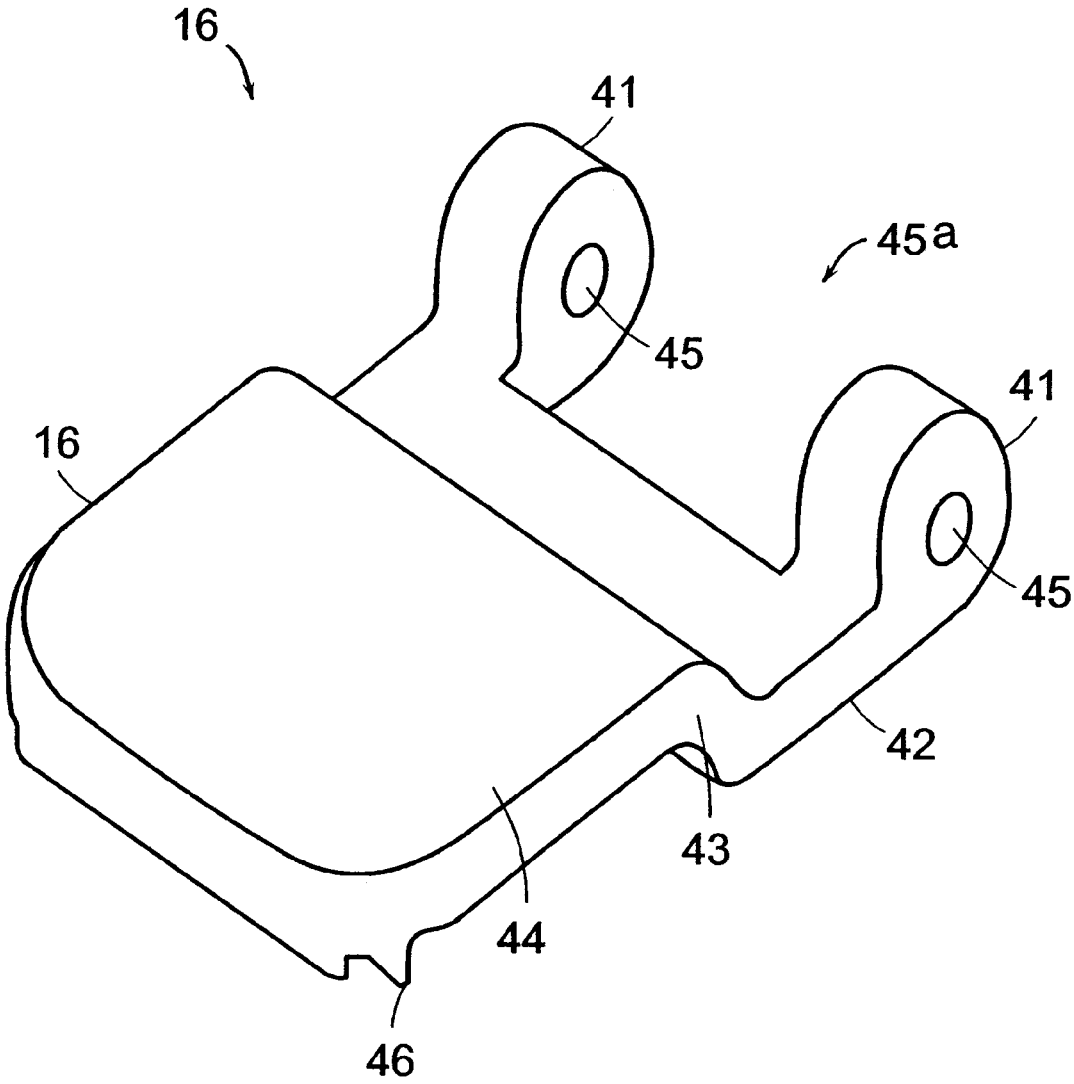
FIG. 4 is a perspective view of a preferred clamp plate.

FIG. 4 shows the clamp plate 16 in more detail. The clamp plate 16 includes a hinge portion 41 that defines holes 45*a* through which pin 14*b* passes to form the hinge that allows the clamp plate 16 to rotate, as described above. Opening 45 provides a space into which a portion of spring 15 (not shown in this figure) may fit, allowing the spring to also wrap around pin 14*b* as described below. Flat section 42, which extends from the hinge portion 41, is the section that contacts the spring 15 as described above. The flat section 42 extends into a vertical segment 43 that transitions into top jaw 44, which curves to define a top jaw of the device 10. Downward projecting teeth 46 help hold an elevator pad. In one embodiment, the clamp plate is about 1.3 inches long and about 1 inch wide. The flat section is about 0.5 inches long and the vertical segment 43 is about 0.2 inches high.

FIG. 5 shows the spring 15 in more detail in an uncompressed state. Spring 15 in one embodiment is formed of a metal exhibiting resilient properties and is about 0.58 inches long L and about 0.6 inches wide W. Spring 15 includes a curved portion 51 that is designed to fit over pin 14*b* and to fit in the cylindrical void 45 of the clamp plate 16. The curved portion transitions into an L-shaped portion in which the shorter leg 52 is about 0.14 inches high. As explained above the spring includes a vertex 24 from which spring portion 26 extends.

Figure 6:
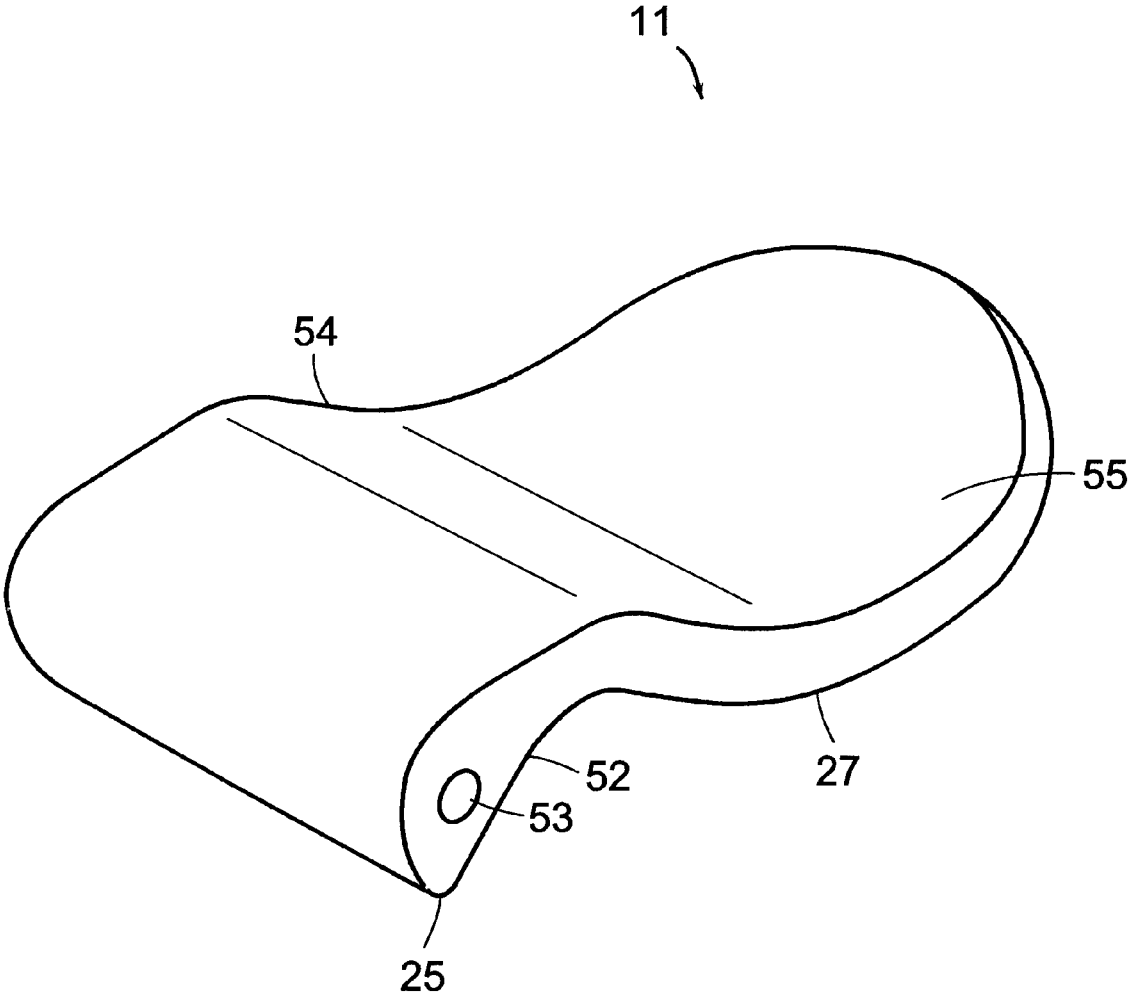
FIG. 6 is a perspective view of a preferred thumb-depressible lever.

FIG. 6 shows the lever 11 in more detail. Lever 11 is about 1.5 inches long and about 1 inch wide. The longitudinal cross-sectional shape has a hinge segment 52 which defines hole 53 through which pin 14*a* passes to form the hinge that allows the back plate 11 to rotate, as described above. The hinge portion 52 extends downward to an urging portion 25 (described above) that extends transversely relative to the major length of the lever 11 and perpendicular to the major surface. This urging portion 25 is the portion that presses the clamp plate 16 down, when the clamping device 10 is in the closed state, and that slides along the clamp plate 16 when the lever is rotated counter to direction A of FIG. 1. Transitional segment 54 extends at an angle away from the hinge segment 52 and into the portion 27 described above that contacts the back plate 16 when the device 10 is in a closed state. The transitional segment 54 further includes a curved profile 55 to facilitate its usage.

To assemble the device, a pin is passed hole 35 and through the curved section 41 of clamp plate 16 and spring 15, while positioning the spring in between the clamp plate 16 and back plate 12. A second pin is then placed through hole 34 and through the cylindrical portions 61, 62 of lever 11. Both pins are then secured.

Having described an exemplary embodiment, it should be apparent to persons of ordinary skill in the art that changes may be made to the embodiment described without departing from the spirit and scope of the invention.

What is claimed is:

1. A clamp for holding elevator pads in an elevator, comprising:

a back plate having an attachment end for holding the back plate in relation to an elevator wall and having two wing segments extending away from a surface of the back plate;

a clamp plate hinged to the wing segments at a clamp axis;

a lever portion hinged to the wing segments at a lever axis, the lever portion having an urging member shaped to urge against a first surface of the clamp plate as the lever portion is rotated about the lever axis to cause the clamp plate to rotate about the clamp axis.

2. The clamp of claim 1 further comprising a spring hinged to the wing segments and positioned to bias the clamp plate in a first state.

3. The clamp of claim 2 wherein the urging member is shaped to substantially disengage from the clamp plate allowing the spring to uncompress to the first state, when the lever portion is rotated into an open state, and wherein, when the lever portion is rotated into a closed state, the urging member presses the clamp plate toward the back plate to compress the spring.

4. The clamp of claim 3 wherein the closed state corresponds with the urging member being substantially perpendicular to the surface of the clamp plate.

5. A method of hanging elevator pads, comprising the steps of:

providing a plurality of clamps each having a lever to position the clamp in one of an open state, defined by open clamp jaws, and a closed state, defined by closed clamp jaws, and each clamp having an elevator attachment feature;

positioning the levers of each clamp to place each clamp in an open state;

positioning the elevator pad in the open jaws of each clamp;

positioning the levers of each clamp to close the jaws of each clamp onto the pad; and placing the clamps so that the elevator attachment feature engages the elevator to hang the elevator pad.

* * * * *